United States Patent [19]

Elliott

[11] Patent Number: 4,811,854

[45] Date of Patent: Mar. 14, 1989

[54] KNUCKLE STRUCTURE TO ENSURE FAILURE AT KNUCKLE THROAT PORTION

[75] Inventor: William O. Elliott, Pittsburgh, Pa.

[73] Assignee: McConway & Torley Corporation, Pittsburgh, Pa.

[21] Appl. No.: 141,525

[22] Filed: Jan. 7, 1988

[51] Int. Cl.[4] ..... B61G 3/04

[52] U.S. Cl. ..... 213/155

[58] Field of Search ..... 213/64, 69, 155, 152, 213/1 R, 1 A, 75 R, 100 R, 160

[56] References Cited

U.S. PATENT DOCUMENTS

| | | | |
|---|---|---|---|
| 2,088,135 | 7/1937 | Johnson et al. | 213/155 |
| 2,688,412 | 9/1954 | Kulieke | 213/155 |
| 4,640,422 | 2/1987 | Elliott | 213/155 |
| 4,645,085 | 2/1987 | Hanula et al. | 213/155 |

*Primary Examiner*—Robert B. Reeves
*Assistant Examiner*—Joseph D. Pape
*Attorney, Agent, or Firm*—Clifford A. Poff; Thomas H. Murray

[57] ABSTRACT

An improved knuckle design for railway couplers wherein the knuckle pin is supported midway between its ends to prevent premature failure of the pin. The kidney core which forms the hollow cavity in the throat portion of the knuckle is isolated from the core which forms the pivot pin hole during casting and is provided with a lateral projection which forms an opening in the side wall of the hollow knuckle throat portion. This insures that under severe stress conditions, the coupler will fracture at the throat portion of the knuckle rather than possibly at the coupler head itself.

4 Claims, 3 Drawing Sheets

KNUCKLE STRUCTURE TO ENSURE FAILURE AT KNUCKLE THROAT PORTION

BACKGROUND OF THE INVENTION

In railway couplers utilized by the American Association of Railroads, coupling of cars is achieved by means of interlocking knuckles pivotally carried on coupler heads by knuckle pins. The coupler heads are relatively massive castings connected to the undercarriages of railway cars and cannot be readily replaced. The knuckles, however, can be easily replaced by removing their associated knuckle pins. Consequently, if a failure (i.e., casting fracture) should occur in the coupler due to fatigue or stress, it is desired that it occur in the easily-replaceable knuckle rather than the coupler head.

It will be appreciated that inter-locking coupler knuckles can be in either compression or tension, depending upon the direction of movement of a train. When movement of a train reverses, the knuckles change from a tension condition to a compression condition; and the nose of each knuckle tends to slam into the throat portion of the other. After a period of time, this results in a metal fatigue condition with attendant cracks in the throat region of the knuckle, causing the knuckle to eventually fail in the throat region. Failure can also occur in the pin itself due to bending loads imposed on the pin upon movement of a train from a stopped position as well as when the train reverses direction. Other conditions which occur during the use of railway couplers bring about repetitive stress loadings on a knuckle pin; and these loadings can eventually cause the pin to fail. Thus, in prior art couplers, failure usually occurs in the knuckle pin itself or in the throat region of the knuckle rather than in the relatively massive coupler head.

In the past, failure of the knuckle usually occurred in the throat or around the knuckle pin hole due to the fact the kidney core used to produce a hollow cavity in the knuckle tail during casting was anchored by a projection into an enlargement of the pin hole core, producing a point of weakness. Previous designs, however, did not give sufficient support to the pin itself, resulting in the possible premature failure of the pin due to fatigue as explained above.

In U.S. Pat. No. 4,640,422 issued to William O. Elliott, a system is described for correcting knuckle pin failure problems. This is achieved by supporting at least a part of the knuckle pin along its length between the top and bottom of pin support walls of the knuckle. This can be achieved by forming an annular rib which projects into the core area of the knuckle about midway between the top and bottom pin support walls of the knuckle, or by a continuous pin-support wall extending along the height of the knuckle; with the pin receiving opening in the wall dimensioned to restrain the pin against lateral bending. In order to achieve this desirable result, however, it becomes necessary to modify the kidney core used to produce the hollow cavity in the knuckle tail such that it no longer projects into and is supported on the core for the pin hole itself. While the system shown in the aforesaid U.S. Pat. No. 4,640,422 is entirely satisfactory for its intended purpose, it does produce a condition wherein the knuckle is strengthened and will not fracture before a possible fracture of the coupler head itself. That is, the knuckle will no longer fracture and will not fail along the throat or pin hole portion.

SUMMARY OF THE INVENTION

In accordance with the present invention, a knuckle for a railroad coupler is provided with a pivot pin hole bounded on one side by a integral hollow throat portion and wherein the pivot pin hole is isolated from the interior hollow cavity of the throat portion and provided with an intermediate annular supporting surface for the pivot pin. This insures against premature failure of the pivot pin due to bending forces as described above.

In order to ensure that the knuckle will fracture at the throat portion, and the coupler head will not fracture when the coupler is under severe stress, the kidney core which forms the hollow cavity of the throat portion is provided with a lateral projection which extends through the side wall of the hollow cavity of the throat portion during casting, whereby an opening is left in the aforesaid side wall after the kidney core is removed after casting to provide a point of weakness which will ensure that the knuckle will fracture at the throat portion.

In this manner, the desirability of premature failure of the pivot pin due to bending moments is avoided and, at the same time, assurance is given that the knuckle will fracture at the throat portion rather than causing a possible fracture of the coupler head under severe stress conditions.

The above and other objects and features of the invention will become apparent from the following detailed description take in connection of the accompanying drawings which form a part of this specification and in which:

FIG. 1 is a perspective view of a typical knuckle of the type manufactured with the use of the present invention;

FIG. 2 is a partially broken away top view of a knuckle manufactured in accordance with the invention;

FIG. 2A is a cross sectional view taken substantially along line IIA—IIA of FIG. 2;

FIG. 3 is a side view of the knuckle shown in FIG. 2;

FIG. 4 is a top view of the lower half of a mold utilized to form the knuckle of the invention, showing the location of the kidney core utilized in the present invention; and FIG. 5 is a perspective view of the kidney core shown in FIG. 4.

BRIEF DESCRIPTION OF THE DRAWINGS

With reference now to the drawings, and particularly to FIGS. 1, 2, 2A, and 3, the coupler knuckle shown includes a nose portion 10 having a front face 12 and a pulling face 14. Continuous with the pulling face 14 is a throat portion 15; and continuous with the front face 12 is a heel 16 which joins with a hub 18 provided with a pivot pin hole 20. Behind the hub portion 18 is a buffing shoulder 19 to which is joined an assembly including the throat portion 15 and a tail portion 22. Tail portion 22 is provided with a locking face 24 and lock shelf 26 which abut against a coupler lock in accordance with conventional practice. The entire knuckle is formed as a single, integral casting.

Within the throat portion 21 is a cavity 28 formed by a kidney core, about to be described, used in the casting process. As best shown in FIG. 2A, the cavity 28 terminates and is spaced from the pin hole 20 such that a relatively large mass of metal 30 surrounds the pin hole 20 and a knuckle pin 32 inserted therein. This prevents premature failure of the pin 32 due to repeated bending loads as described above.

Figure 1:
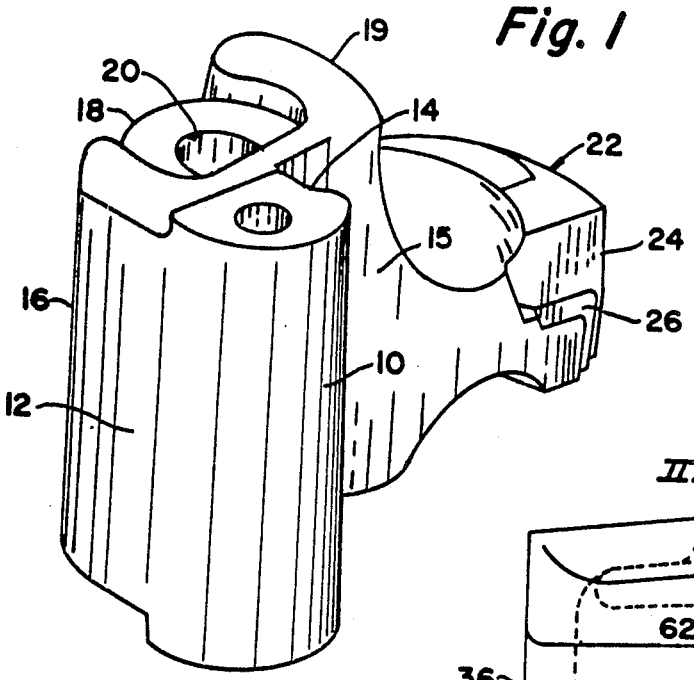
Figure 2:
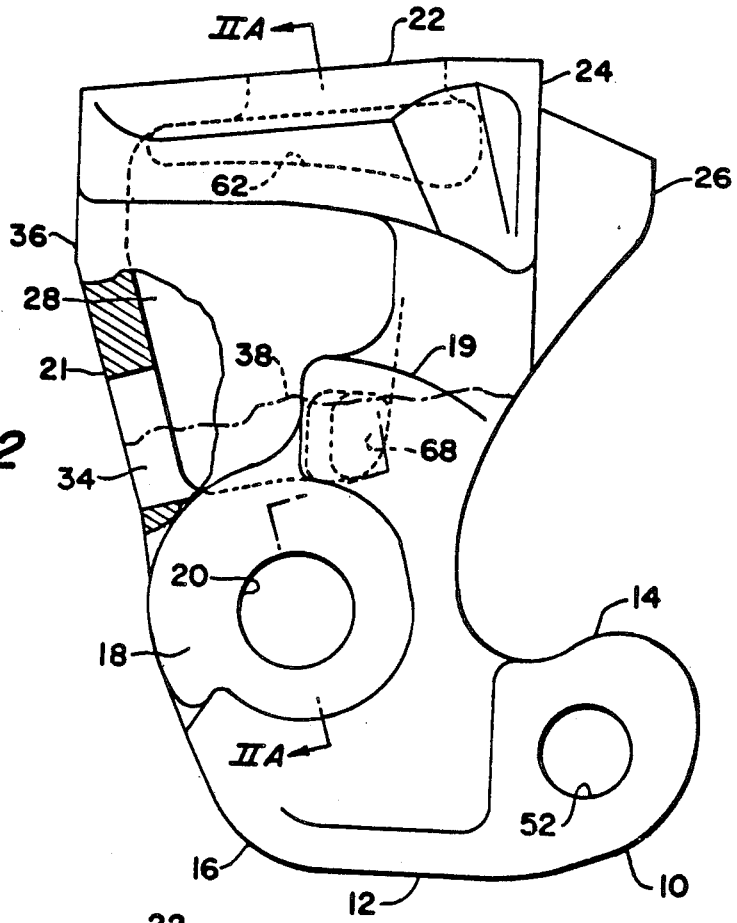
Figure 3:
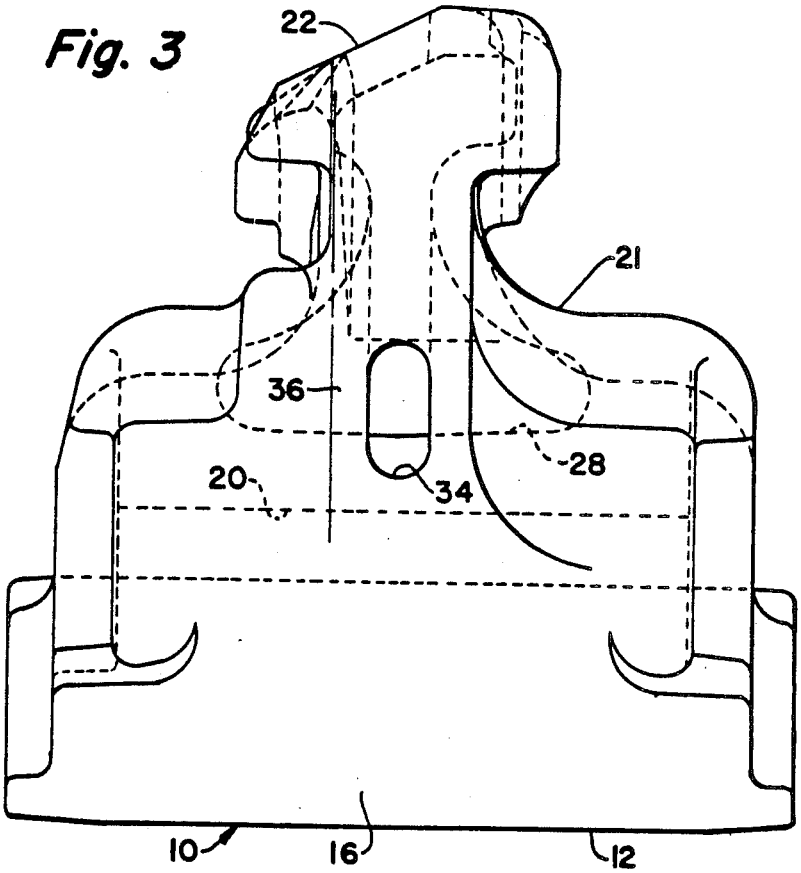

Because of a relatively large mass of metal 30 surrounding the pin hole 20, the knuckle is strengthened in the area of the pin hole. Furthermore, without the present invention, the throat portion 21 was too strong and would not readily fracture either, the result being that it was possible to fracture the coupler head which carries the knuckle shown in FIGS. 1-3. In accordance with the present invention, therefore, an opening 34 is provided in the side wall 36 (FIGS. 2 and 3) of the throat portion 21. This ensures that under overload conditions, fracture will occur in throat portion 21 approximately along the fracture line 38 shown in FIG. 2. In other words, the opening 34 formed in the side wall 36 produces a point of weakness, ensuring that if a fracture does occur, it will occur in the knuckle, specifically at the throat portion 21 of the knuckle.

Figure 2A:
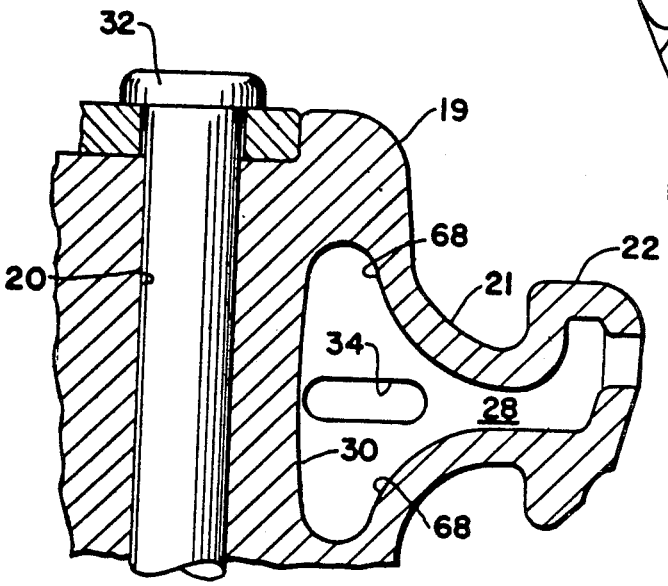
Figure 4:
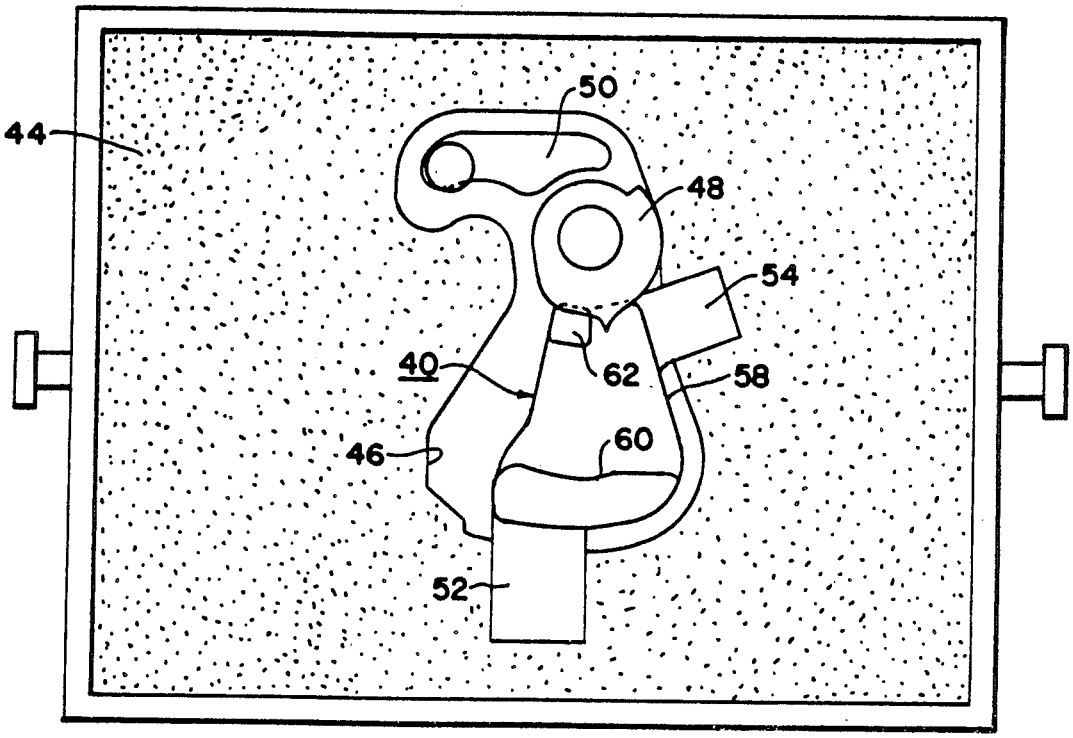
Figure 5:
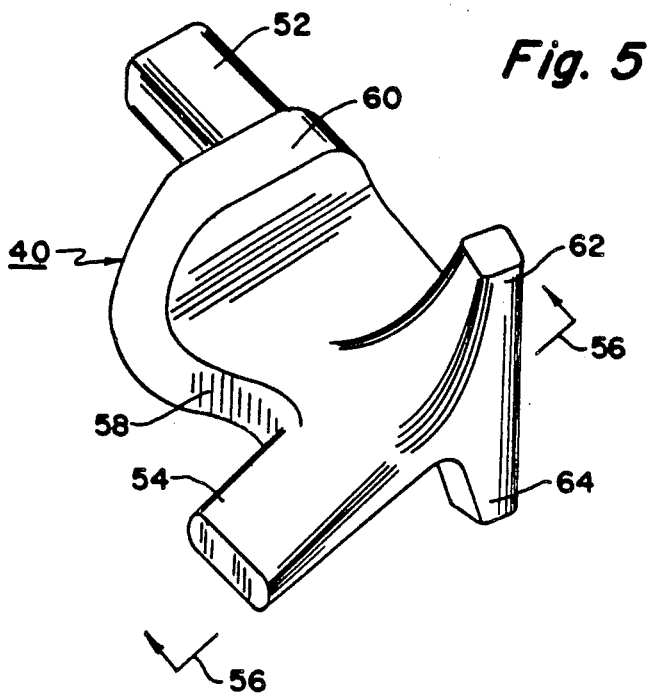

The throat cavity 28 is formed in the throat portion 21 with a so called kidney core during the casting process. The kidney core is shown in FIGS. 4 and 5 and is identified generally by the reference numeral 40. In FIG. 4, the lower half 42 of a casting mold is shown. It is filled with casting sand 44 having a cavity 46 therein which forms the lower half of the knuckle. Received within the cavity 46 is the kidney core 40 as well as pin hole core 48 and a front core 50 which forms a cavity in the nose portion 10 as well as a flag hole 52 (see also FIGS. 1 and 2). The kidney core 40 is provided with a rear lug or projection 52 as well as a side projection 54 which rests on the sand 44 such that approximately ½ of the kidney core is above the center line of the casting and the other half is below the center line of the casting substantially along line 56—56 (FIG. 5). The kidney core has a main central body portion 58 and an upstanding portion 60 at its rear end which forms the cavity 62, shown in FIG. 2. Portions 62 and 64 extend upwardly and downwardly from the main central portion 58 to form the cavity 68, shown in FIGS. 2 and 2A.

The lateral projection 54 serves two purposes. It anchors the core within the mold, thereby ensuring a uniform wall thickness of the cavity 28, such as wall 36 through which the opening 34 extends. At the same time, it also forms the opening 34 during the casting process. As mentioned above, this ensures that the knuckle will fracture approximately along fracture line 38 under excessive load conditions rather than another part of the coupler.

Although the invention has been shown in connection with a certain specific embodiment, it will be readily apparent to those skilled in the art that various changes in form and arrangement of parts can be made to suit requirements without departing from the spirit and scope of the invention.

I claim:

1. In a knuckle for a railway coupler provided with a pivot pin hole bounded on one side by a integral hollow throat portion and wherein the pivot pin hole is isolated from the interior of the hollow cavity of the throat portion and provided with an intermediate annular supporting surface for the pivot pin, the improvement in said knuckle wherein the kidney core which forms the hollow cavity of the throat portion is provided with a lateral projection which extends through the side wall of the hollow cavity of the throat portion, whereby an opening is left in the aforesaid side wall when the kidney core is removed after casting to provide a point of weakness which will ensure that the knuckle will fracture at the throat portion when the knuckle is under severe stress.

2. The improvement of claim wherein said kidney core is provided with a second, rearwardly extending projection which forms an opening in the end wall forming the tail of the knuckle.

3. The improvement of claim 1 wherein the kidney core is isolated from a core which forms the pivot pin hole during casting.

4. The improvement of claim 3 wherein the intermediate annular supporting surface extends substantially along the entire length of the pin hole.

* * * * *